United States Patent [19]

Lecinski, Jr.

[11] 4,228,909

[45] Oct. 21, 1980

[54] SQUEEZE-OFF CLOSURE WITH TAMPER INDICATING BAND

[75] Inventor: Frank H. Lecinski, Jr., Harwood Heights, Ill.

[73] Assignee: The Continental Group, Inc., New York, N.Y.

[21] Appl. No.: 50,932

[22] Filed: Jun. 21, 1979

[51] Int. Cl.[3] ..... B65D 41/32

[52] U.S. Cl. ..... 215/253; 215/262; 215/321; 215/346; 292/256.6

[58] Field of Search ..... 215/31, 262, 253, 254, 215/321, 345, 346, 274; 220/270, 266, 319; 292/256.6, 256.63

[56] References Cited

U.S. PATENT DOCUMENTS

| | | | |
|---|---|---|---|
| 2,510,824 | 6/1950 | Lafarge | 220/281 |
| 2,817,453 | 12/1957 | Stover | 215/352 X |
| 3,057,503 | 10/1962 | Salzmann | 215/253 |
| 3,128,896 | 4/1964 | Schnier | 215/364 |
| 3,489,308 | 1/1970 | Podesta | 215/346 X |
| 3,690,499 | 9/1972 | Westfall | 215/253 |
| 3,746,199 | 7/1973 | Hart | 215/346 X |

*Primary Examiner*—Donald F. Norton
*Attorney, Agent, or Firm*—Charles E. Brown

[57] ABSTRACT

This disclosure relates to a closure assembly for containers, particularly glassware containers, wherein the closures may be readily removed even when the product is vacuum packed by the deformation of the cup-shaped body of the closure and the sealing ring through the application of a diametrically opposite squeezing pressure. Normally the deformation of the closure body is prevented by a removable tamper indicating ring which interlocks with the skirt of the closure body and which must be ruptured to effect the removal thereof. The closure may assume various configurations depending upon whether the container is to be reclosed and whether there is an internal vacuum. The closure construction permits a modified sealing surface finish on the glassware container.

18 Claims, 10 Drawing Figures

SQUEEZE-OFF CLOSURE WITH TAMPER INDICATING BAND

This invention relates in general to new and useful improvements in container closures, and more particularly to a container closure which is provided with a tamper indicating ring.

This invention most particularly relates to a closure which is intended for use in conjunction with products which are vacuum packed and wherein, in order to effect the removal of the closure, it is necessary to break the seal between the closure and the finish of the container so as to relieve the internal vacuum.

In accordance with this invention it is proposed to provide a closure which includes a flexible cap-like body having an internal sealing ring which is held in sealed engagement with the finish of the container primarily by the internal vacuum within the container and wherein, when the cap-like body is squeezed at diametrically opposite points, the cap-like body will deform sufficiently to raise the sealing ring out of contact with the container finish and thus relieve the vacuum within the container so as to permit the ready removal of the closure.

Most particularly in accordance with this invention, the closure has associated therewith a tamper indicating ring which engages between the skirt of the cap-like body and the container, and when in place prevents the squeezing of the cap-like body sufficiently to release the seal between the closure and the container.

In accordance with the invention, the tamper indicating ring is rupturable and is readily removable from the closure, and when ruptured is readily indicative of such condition.

Another feature of the invention is that the tamper indicating ring is first assembled with the closure and the closure and ring are applied simultaneously to the container.

Another feature of the invention is the provision of the sealing ring of the closure with suitable lugs which interlock with the exterior of the container finish so as to permit reclosing of the container.

A further feature of the invention is the utilization of the tamper indicating ring to form an interlock with the finish on the container, and thus secure the closure in place independently of any vacuum within the container.

A further feature of the invention is the formation of the closure such that only the resilient sealing material of the sealing ring is engageable with the sealing surface of the container which is preferably formed of glass such that the configuration of the finish of the container may be suitably varied to provide a maximum sealing surface without the customary danger of glass chipping.

With the above and other objects in view that will hereinafter appear, the nature of the invention will be more clearly understood by reference to the following detailed description, the appended claims, and the several views illustrated in the accompanying drawings.

Figure 1:
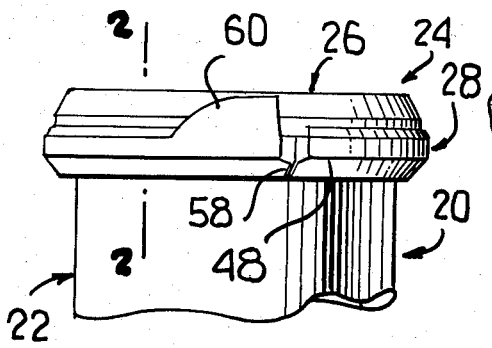
FIG. 1 is a schematic side elevational view of the upper portion of a container closed with a closure in accordance with this invention.

Referring now to the drawings in detail, it will be seen that there is illustrated in FIG. 1 a container assembly formed in accordance with this invention, the container assembly being generally identified by the numeral 20 and including a container, generally identified by the numeral 22, and a closure assembly, generally identified by the numeral 24. The closure assembly 24 includes a closure, generally identified by the numeral 26, and a tamper indicating ring, generally identified by the numeral 28.

In accordance with this invention, the container 22 is preferably in the form of glassware and in the simplest form of the invention may be a reusable glass or tumbler having a rounded sealing surface 30 at the upper end thereof.

The closure 26 includes a cap-like body 32 having an end panel 34 and a depending skirt 36. The skirt 36 preferably has an inwardly and upwardly tapering upper portion 38 which is joined to an upwardly offset peripheral portion 40 of the end panel 34. The skirt 36 terminates in an inturned curl 42.

The sealing ring 44 is seated in a channel 46 generally defined by the offset portion 40 of the end wall 34. The sealing ring 44 is formed of any suitable deformable gasket material such as that which is customarily utilized as sealing rings in closures of this type.

It is to be noted that the skirt 36 is of a materially greater diameter then the exterior of the container 22 so that the skirt 36 may be radially inwardly deformed at diametrically opposite points for a purpose to be described hereinafter.

In order to prevent the undesired inward deformation of the skirt 36, there is provided the tamper indicating ring 28. The tamper indicating ring 28 is also preferably formed of a suitable plastic material and includes a continuous band portion 48 which is generally angular in outline and which includes an upper portion 50 which engages about the exterior of the skirt 36, and a lower portion 52 which extends downwardly and radially inwardly adjacent the exterior of the container 22. The lower portion 52 is provided at circumferentially spaced points with a plurality of radially extending lugs 54 which extend vertically so as to overlap the skirt 36. Each lug 54 is provided with a notch 56 for interlockingly receiving the curl 42. The lugs 54 function as spacers, preventing the radially inward deformation of the skirt 36 when the tamper indicating ring is in place.

Figure 3:
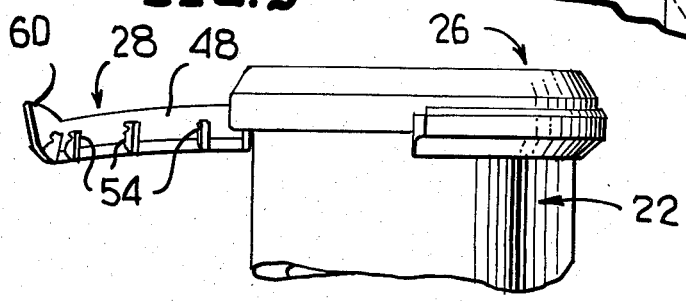
FIG. 3 is a side elevational view similar to FIG. 1, and shows the tamper indicating ring in the process of being removed.

Referring once again to FIG. 1, it will be seen that the tamper indicating ring 28 has formed in the band 48 thereof an axial weakened area 58 so as to facilitate the controlled rupture of the band. Further, the band 48 is provided with an upstanding ear 60 which may be readily engaged by one's thumb so as first to effect the rupture of the band 48 and then the removal of the tamper indicating ring 28 in a progressive manner as shown in FIG. 3.

Figure 2:
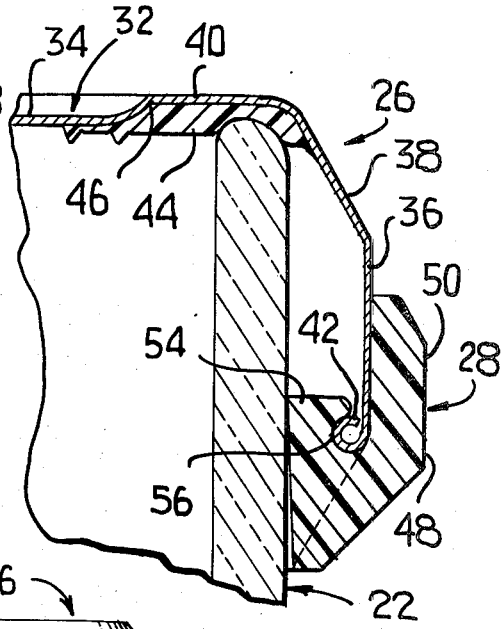
FIG. 2 is an enlarged fragmentary vertical sectional view taken generally along the line 2—2 of FIG. 1.
Figure 4:
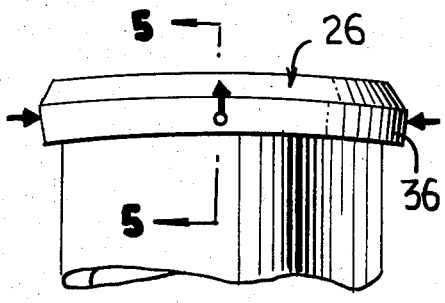
FIG. 4 is a side elevational view similar to FIG. 1, with the tamper indicating ring removed and the closure being deformed to break the vacuum seal.
Figure 5:
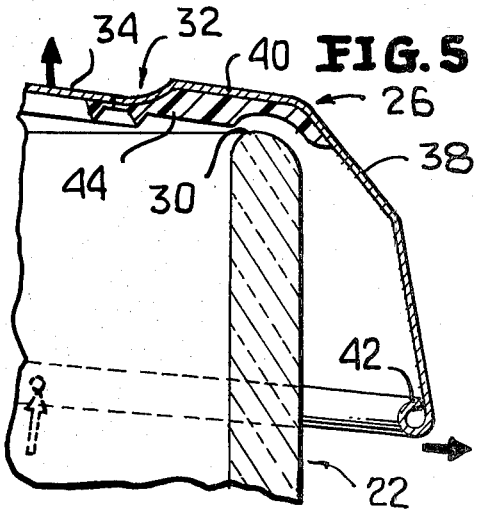
FIG. 5 is a fragmentary enlarged vertical sectional view taken generally along the line 5—5 of FIG. 4, and shows the deformation of the cap-like body.

It is to be understood that in the embodiment specifically illustrated in FIG. 2, the closure 26 is substantially completely held in sealed engagement with the glassware container 22 by the vacuum within the container 22. In order to remove the closure 26, it is merely necessary to break the seal between the sealing ring 44 and the sealing surface 30. As is schematically shown in FIG. 4, this can be effected by pressing the skirt 36 radially inwardly at two diametrically opposite points which, due to the flexibility and resiliency of the cup-shaped body 32, results in the upward flexing of the body 32 90° away from the points of pressure application, thereby breaking the seal between the sealing ring 44 and the sealing surface 30 as is clearly shown in FIG. 5. It will be understood that the skirt 36 cannot be radially inwardly deformed as long as the tamper indicating ring 28 is in place.

Figure 6:
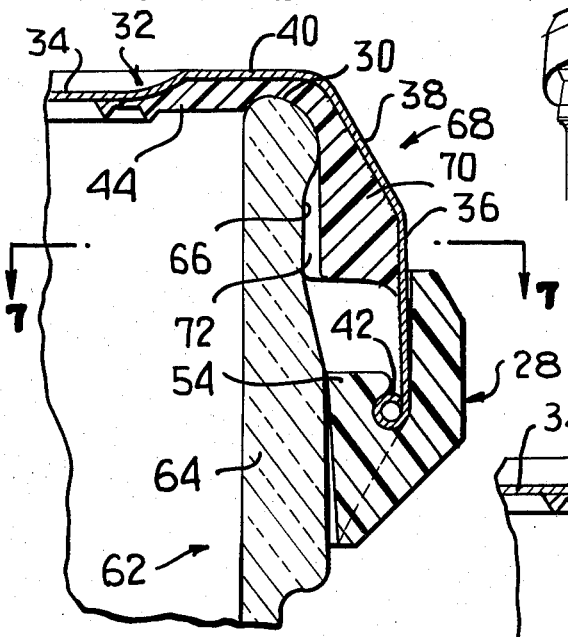
FIG. 6 is a vertical sectional view similar to FIG. 2, and shows a modified form of container finish and sealing ring.

The closure 26 is not intended to be replaceable. However, the same features of the invention may be employed in conjunction with a reclosable container assembly as shown in FIG. 6 and generally identified by the numeral 62. The closure assembly 62 includes a container 64 preferably formed of glass and having an external finish which is recessed as at 66 in addition to the sealing surface finish 30.

The container assembly 62 further includes a closure 68 which is identical to the closure 26 including the cup-shaped body 32 and the sealing ring 44, except that the sealing ring 44 is provided with a downwardly extending circumferential extension 70. The sealing ring extension 70 is provided at spaced intervals with lugs 72 which interlock with the glassware finish 66 so as to hold the closure 68 on the container 64 independent of any vacuum holding force which may exist.

Figure 8:
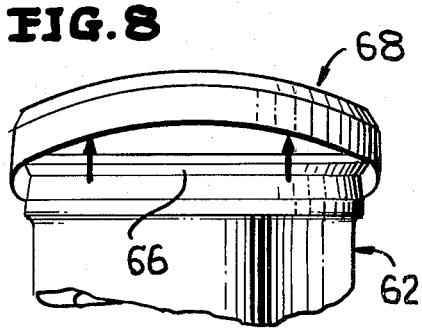
FIG. 8 is a fragmentary side elevational view similar to FIG. 1, and shows the manner in which the closure of FIG. 6 is pushed from the container after the initial seal has been broken.

The function and usage of the closure 68 is identical with that of the closure 26, and therefore it also includes a tamper indicating ring 28 which functions exactly in the manner described above with respect to the closure 26. However, once the vacuum seal is broken between the sealing ring 44 and the sealing surface 30, it is necessary to exert a positive pushing pressure to remove the closure 68 as is generally shown in FIG. 8.

It is to be understood that the interlock between the lug 72 and the finish 66 is one which permits the retention of the closure 68 in place so as to permit reclosing of the container 64. The amount of retention by the lugs 72 may be readily varied either by controlling the circumferential extent of the lugs or by controlling the interlock between the lugs and the finish 66. In other words, the lugs 72 may have more or less material in a radial direction so as to hold the lugs more firmly or less firmly against the finish 66.

Figure 9:
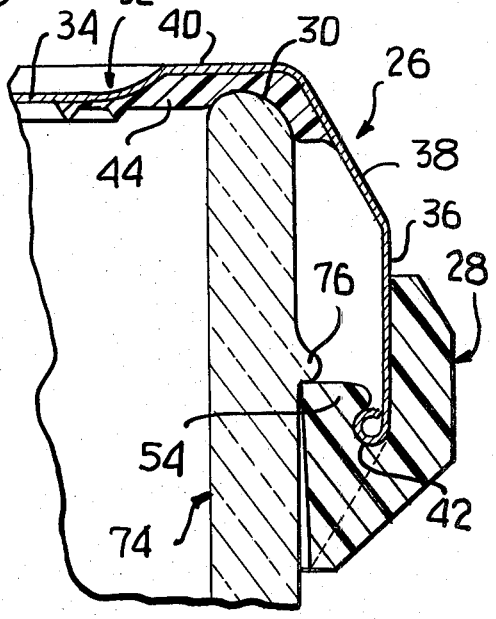
FIG. 9 is another vertical sectional view similar to FIG. 2, and shows a further type of retaining relationship.
Figure 7:
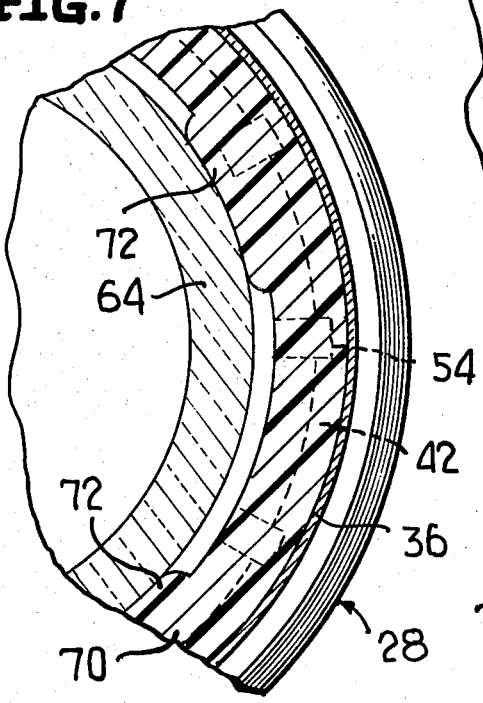
FIG. 7 is a fragmentary horizontal sectional view taken generally along the line 7—7 of FIG. 7.

When it is desired that the finish of the container be a simple one, the invention can be utilized even though the closure is not held in place by way of an internal vacuum. Referring now to FIG. 9, it will be seen that the closure 26 and the tamper indicating ring 28 may be utilized in conjunction with a container 74 which is modified as compared to the container 22 only in that the container 22 has an annular rib 76 projecting radially therefrom for engagement by the upper ends of the lugs 54 as is best shown in FIG. 9. Thus, the lugs 54 serve to hold the tamper indicating ring 28 in an axial position on the container 74 and the interlocking of the tamper indicating ring with the curl 42 serves to hold the cup-shaped body 32 in place with the sealing ring 44 in sealed engagement with the sealing surface 30. Once the tamper indicating ring 28 is removed in the manner shown in FIG. 3, the closure 26 may be readily removed.

It is also pointed out here that it is feasible to employ the rib 76 in the assembly shown in FIG. 6 wherein the sealing ring 44 has the extension 70 and the lugs 72.

Figure 10:
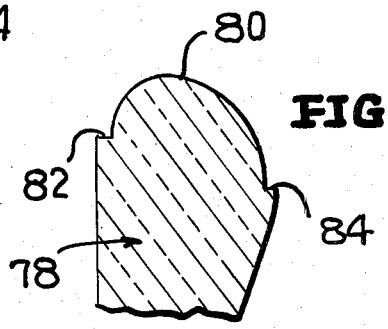
FIG. 10 is an enlarged fragmentary sectional view showing a modified form of finish on the container.

At this time it is also pointed out that a definite advantage can be obtained with the closure configurations of this invention as far as the forming of the sealing surface on the glassware container is concerned. Referring now to FIG. 10, it will be seen that there is illustrated a container 78 having a sealing surface 80 which is of a very great extent. It is also to be noted that at the upper ends of the sealing surface 80 the container 78 has shoulders 82, 84 which are the natural result of the parting lines between the various die members forming the upper configuration and sealing suraces of the container. These shoulders 82, 84 are subject to chipping when engaged by a hard surface. This is particularly true of the shoulder 84 which normally would be engaged by the metallic body member of the closure. However, the skirt 36 is widely spaced from the exterior surface of the container and cannot possibly engage the shoulder 84 during application or reclosure so as to cause chipping. Thus, the finish shown in FIG. 10 has definite advantages in view of the simplicity of the mold structure and the extent of the sealing surface 80.

Although only several preferred embodiments of the invention have been specifically illustrated and described herein, it is to be understood that minor variations may be made in the closure assemblies without departing from the spirit and scope of the invention as defined by the appended claims.

I claim:

1. A closure assembly comprising a closure member including a one piece body having a generally flat full end panel and a depending skirt; a separate sealing ring within said body for sealingly engaging a container terminal sealing surface, and a tamper indicating ring carried by said skirt, said tamper indicating ring having a portion removable therewith disposed radially inwardly of and within said skirt for normally preventing radial inward deflection of said skirt sufficient to effect deformation of said sealing ring to a non-sealing configuration.

2. The closure assembly of claim 1 wherein said tamper indicating ring includes a continuous band having at least one line of weakening therein for effecting rupture of said band for freeing said entire tamper indicating ring for removal.

3. The closure assembly of claim 1 wherein said closure assembly is carried by a container having a sealing finish engaged by said sealing ring.

4. The closure assembly of claim 3 wherein said container is a glass container.

5. The closure assembly of claim 3 wherein said container has a radially projecting rib and said tamper indicating ring is locked below said container rib to retain said closure member on said container.

6. The closure assembly of claim 5 wherein said skirt terminates in a curl and said tamper indicating ring has an axially opening socket receiving said curl for maintaining said closure assembly as a unit for application.

7. A closure assembly comprising a closure member including a one piece body having a generally flat full end panel and a depending skirt; a separate sealing ring within said body for sealingly engaging a container terminal sealing surface, and a tamper indicating ring carried by said skirt, said tamper indicating ring having a portion removable therewith disposed radially inwardly of and within said skirt for normally preventing radial inward deflection of said skirt sufficient to effect deformation of said sealing ring to a non-sealing configuration, said skirt terminating in a curl and said tamper indicating ring having an axially opening socket receiving said curl for maintaining said closure assembly as a unit for application.

8. A closure assembly comprising a closure member including a one piece body having a generally flat full end panel and a depending skirt; a separate sealing ring within said body for sealingly engaging a container terminal sealing surface, and a tamper indicating ring carried by said skirt, said tamper indicating ring having a portion removable therewith disposed radially inwardly of and within said skirt for normally preventing radial inward deflection of said skirt sufficient to effect deformation of said sealing ring to a non-sealing configuration, said ring portion being in the form of a plurality of circumferentially spaced lugs.

9. A closure assembly comprising a closure member including a one piece body having a generally flat full end panel and a depending skirt; a separate sealing ring within said body for sealingly engaging a container terminal sealing surface, and a tamper indicating ring carrier by said skirt, said tamper indicating ring having a portion removable therewith disposed radially inwardly of and within said skirt for normally preventing radial inward deflection of said skirt sufficient to effect deformation of said sealing ring to a non-sealing configuration, said body being formed of a resilient flexible material and shaped to bulge upwardly when diametrically squeezed along a line generally normal to the line of diametrical squeezing.

10. A closure assembly comprising a closure member including a one piece body having a generally flat full end panel and a depending skirt; a separate sealing ring within said body for sealingly engaging a container terminal sealing surface, and a tamper indicating ring carried by said skirt, said tamper indicating ring having a portion removable therewith disposed radially inwardly of and within said skirt for normally preventing radial inward deflection of said skirt sufficient to effect deformation of said sealing ring to a non-sealing configuration, said sealing ring having a depending portion adjacent said skirt, and rib means carried by said sealing ring depending portion for interlocking with the external finish of a container for effecting use of said closure member as a reclosure member.

11. A closure assembly comprising a closure member including a one piece body having a generally flat full end panel and a depending skirt; a separate sealing ring within said body for sealingly engaging a container terminal sealing surface, and a tamper indicating ring carried by said skirt, said tamper indicating ring having a portion removable therewith disposed radially inwardly of and within said skirt for normally preventing radial inward deflection of said skirt sufficient to effect deformation of said sealing ring to a non-sealing configuration, and a vacuum within said container with said vacuum acting on said closure member for holding said sealing ring in sealing engagement with said sealing finish.

12. The closure assembly of claim 11 wherein said vacuum forms the sole means for retaining said closure on said container.

13. The closure assembly of claim 11 wherein said body is formed of a resilient flexible material and shaped to bulge upwardly when diametrically squeezed along a line generally normal to the line of diametrical squeezing, said upward bulging being such as to break the seal between said sealing ring and said sealing surface.

14. The closure assembly of claim 11 wherein said sealing ring has a depending portion adjacent said skirt, and rib means are carried by said sealing ring depending portion for interlocking with the external finish of said container for effecting use of said closure member as a reclosure member.

15. A closure assembly comprising a closure member including a one piece body having a generally flat full end panel and a depending skirt; a separate sealing ring within said body for sealingly engaging a container terminal sealing surface, and a tamper indicating ring carried by said skirt, said tamper indicating ring having a portion removable therewith disposed radially inwardly of and within said skirt for normally preventing radial inward deflection of said skirt sufficient to effect deformation of said sealing ring to a non-sealing configuration, said closure assembly being carried by a container having a sealing finish engaged by said sealing ring, said sealing ring having a depending portion adjacent said skirt, and lug means carried by said sealing ring depending portion for interlocking with the external finish of a container for effecting use of said closure member as a reclosure member.

16. A tamper indicating ring for use with a closure having a depending skirt intended to be spaced from an adjacent container wall, said tamper indicating ring including a continuous band having at least one line of weakening for effecting rupture of said band, said band having radially inwardly projecting lug means for positioning between a container and a closure skirt, and means for interlocking said lug means to a closure skirt.

17. The tamper indicating ring of claim 16 wherein said lug means are in the form of a plurality of radial lugs disposed in circumferentially spaced relation.

18. The tamper indicating ring of claim 16 wherein said lug means are in the form of a plurality of radial lugs disposed in circumferentially spaced relation, and socket means formed in said lugs adjacent intersections between said lugs and said band for interlockingly receiving a free edge of a closure skirt.

* * * * *